US006962021B2

(12) United States Patent
Weder

(10) Patent No.: US 6,962,021 B2
(45) **Date of Patent: *Nov. 8, 2005**

(54) PLANT SLEEVE

(75) Inventor: Donald E. Weder, Highland, IL (US)

(73) Assignee: Wanda H. Weder and William F. Straeter, Highland, IL (US); not individually but solely as Trustees of the Family Trust U/T/A dated December 8, 1995.

( * ) Notice: Subject to any disclaimer, the term of this patent is extended or adjusted under 35 U.S.C. 154(b) by 0 days.

This patent is subject to a terminal disclaimer.

(21) Appl. No.: 10/666,576

(22) Filed: Sep. 17, 2003

(65) Prior Publication Data

US 2004/0074797 A1 Apr. 22, 2004

Related U.S. Application Data

(63) Continuation of application No. 10/195,595, filed on Jul. 12, 2002, now Pat. No. 6,647,663, which is a continuation-in-part of application No. 09/956,833, filed on Sep. 20, 2001, now Pat. No. 6,438,898, which is a continuation-in-part of application No. 09/327,721, filed on Jun. 8, 1999, now Pat. No. 6,295,760, which is a continuation-in-part of application No. 09/022,958, filed on Feb. 12, 1998, now Pat. No. 5,910,051, which is a continuation of application No. 08/788,616, filed on Jan. 27, 1997, now Pat. No. 5,749,171.

(51) Int. Cl.[7] ..... A47G 7/08
(52) U.S. Cl. ..... 47/72
(58) Field of Search ..... 47/72, 47.01; 206/42.3

(56) References Cited

U.S. PATENT DOCUMENTS 524,219 A 8/1894 Schmidt
732,889 A 7/1903 Paver
950,785 A 3/1910 Pene (Continued)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 15550 | 6/1900 |
| DE | 345464 | 12/1921 |
| DE | 513971 | 11/1930 |

(Continued)

OTHER PUBLICATIONS

Speed Cover Brochure, "The Simple Solution For Those Peak Volume Periods", Highland Supply Corporation, ©1989.

"Speed Sheets and Speed Rolls" Brochure, Highland Supply Corporation, ©1990.

"Color Them Happy with Highlander Products" [201] 1992.

*Primary Examiner*—Jeffrey L. Gellner
(74) *Attorney, Agent, or Firm*—Dunlap, Codding & Rogers, P.C.

(57) ABSTRACT

A sleeve comprising a lower portion preferably having a base portion and a skirt portion for packaging a floral grouping or plant. The sleeve may have an upper portion which can be detached from the lower portion of the sleeve once the function of the upper portion has been completed. The sleeve has a plurality of horizontally and diagonally positioned expansion elements.

22 Claims, 3 Drawing Sheets

U.S. PATENT DOCUMENTS

| | | | | | |
|---|---|---|---|---|---|
| 1,044,260 | A | | 11/1912 | Schloss | |
| 1,063,154 | A | | 5/1913 | Bergen | |
| 1,446,563 | A | | 2/1923 | Hughes | |
| 1,520,647 | A | | 12/1924 | Hennigan | |
| 1,525,015 | A | | 2/1925 | Weeks | |
| 1,610,652 | A | | 12/1926 | Bouchard | |
| 1,697,751 | A | | 1/1929 | Blake | 229/87 |
| 1,794,212 | A | | 1/1929 | Snyder | |
| 1,811,574 | A | | 3/1930 | Barrett | |
| 1,863,216 | A | | 6/1932 | Wordingham | |
| 1,978,631 | A | | 10/1934 | Herrlinger | 91/68 |
| 2,048,123 | A | | 7/1936 | Howard | 229/87 |
| RE21,065 | E | | 5/1939 | Copeman | 206/56 |
| 2,170,147 | A | | 8/1939 | Lane | 93/2 |
| 2,200,111 | A | | 5/1940 | Bensel | 229/1.5 |
| 2,278,673 | A | | 4/1942 | Savada et al. | 154/43 |
| 2,302,259 | A | | 11/1942 | Rothfuss | 41/10 |
| 2,323,287 | A | | 7/1943 | Amberg | 229/53 |
| 2,355,559 | A | | 8/1944 | Renner | 229/8 |
| 2,371,985 | A | | 3/1945 | Freiberg | 206/46 |
| 2,411,328 | A | | 11/1946 | MacNab | 33/12 |
| 2,510,120 | A | | 6/1950 | Leander | 117/122 |
| 2,529,060 | A | | 11/1950 | Trillich | 117/68.5 |
| 2,621,142 | A | | 12/1952 | Wetherell | 154/117 |
| 2,648,487 | A | | 8/1953 | Linda | 229/55 |
| 2,688,354 | A | | 9/1954 | Berger | 150/28 |
| 2,774,187 | A | | 12/1956 | Smithers | 47/41 |
| 2,822,287 | A | | 2/1958 | Avery | 117/14 |
| 2,846,060 | A | | 8/1958 | Yoont | 206/58 |
| 2,850,842 | A | | 9/1958 | Eubank, Jr. | 47/58 |
| 2,883,262 | A | | 4/1959 | Borin | 21/56 |
| 2,989,828 | A | | 6/1961 | Warp | 53/390 |
| 3,022,605 | A | | 2/1962 | Reynolds | 47/58 |
| 3,080,680 | A | | 3/1963 | Reynolds | 47/37 |
| 3,094,810 | A | | 6/1963 | Kaplin | 47/37 |
| 3,293,100 | A | | 8/1963 | Questel | |
| 3,121,647 | A | | 2/1964 | Harris et al. | 118/202 |
| 3,130,113 | A | | 4/1964 | Silman | 161/97 |
| 3,316,675 | A | | 5/1965 | Cartwright, Jr. | |
| 3,271,922 | A | | 9/1966 | Wallerstein et al. | 53/3 |
| 3,322,325 | A | | 5/1967 | Bush | 229/62 |
| 3,376,666 | A | | 4/1968 | Leonard | 47/41 |
| 3,380,646 | A | | 4/1968 | Doyen et al. | 229/57 |
| 3,423,008 | A | * | 1/1969 | Mykleby | 229/110 |
| 3,431,706 | A | | 3/1969 | Stuck | 53/390 |
| 3,508,372 | A | | 4/1970 | Wallerstein et al. | 53/3 |
| 3,510,054 | A | | 5/1970 | Sanni et al. | 229/66 |
| 3,512,700 | A | | 5/1970 | Evans et al. | 229/53 |
| 3,550,318 | A | | 12/1970 | Remke et al. | 47/37 |
| 3,552,059 | A | | 1/1971 | Moore | 47/41.12 |
| 3,554,434 | A | | 1/1971 | Anderson | 229/55 |
| 3,556,389 | A | | 1/1971 | Gregoire | 229/53 |
| 3,557,516 | A | | 1/1971 | Brandt | 206/59 |
| 3,620,366 | A | | 11/1971 | Parkinson | 206/59 |
| 3,681,105 | A | | 8/1972 | Milutin | 117/15 |
| 3,767,104 | A | | 10/1973 | Bachman et al. | 229/7 |
| 3,793,799 | A | | 2/1974 | Howe | 53/32 |
| 3,869,828 | A | | 3/1975 | Matsumoto | 47/34.11 |
| 3,888,443 | A | | 6/1975 | Flanigen | 248/152 |
| 3,962,503 | A | | 6/1976 | Crawford | 428/40 |
| 4,043,077 | A | | 8/1977 | Stonehocker | 47/66 |
| 4,054,697 | A | | 10/1977 | Reed et al. | 428/40 |
| 4,091,925 | A | | 5/1978 | Griffo et al. | 206/423 |
| 4,113,100 | A | | 9/1978 | Soja et al. | 206/602 |
| 4,118,890 | A | | 10/1978 | Shore | 47/28 |
| 4,149,339 | A | | 4/1979 | Hall et al. | 47/67 |
| 4,189,868 | A | | 2/1980 | Tymchuck et al. | 47/84 |
| 4,216,620 | A | | 8/1980 | Weder et al. | 47/72 |
| 4,248,347 | A | | 2/1981 | Trimbee | 206/423 |
| D259,333 | S | | 5/1981 | Charbonneau | D9/306 |
| 4,265,049 | A | | 5/1981 | Gorewitz | 47/26 |
| 4,280,314 | A | | 7/1981 | Stuck | 53/241 |
| 4,297,811 | A | | 11/1981 | Weder | 47/72 |
| 4,333,267 | A | | 6/1982 | Witte | 47/84 |
| 4,347,686 | A | | 9/1982 | Wood | 47/73 |
| 4,380,564 | A | | 4/1983 | Cancio et al. | 428/167 |
| 4,400,910 | A | | 8/1983 | Koudstaal et al. | 47/84 |
| 4,413,725 | A | | 11/1983 | Bruno et al. | 206/45.33 |
| 4,508,223 | A | | 4/1985 | Catrambone | 206/423 |
| D279,279 | S | | 6/1985 | Wagner | D11/143 |
| 4,546,875 | A | | 10/1985 | Zweber | 206/0.82 |
| 4,621,733 | A | | 11/1986 | Harris | 206/423 |
| 4,640,079 | A | | 2/1987 | Stuck | 53/390 |
| 4,717,262 | A | | 1/1988 | Roen et al. | 383/120 |
| 4,733,521 | A | | 3/1988 | Weder et al. | 53/580 |
| 4,765,464 | A | | 8/1988 | Ristvedt | 206/0.82 |
| 4,771,573 | A | | 9/1988 | Stengel | 47/67 |
| 4,773,182 | A | | 9/1988 | Weder et al. | 47/72 |
| 4,801,014 | A | | 1/1989 | Meadows | 206/423 |
| 4,810,109 | A | | 3/1989 | Castel | 383/105 |
| 4,835,834 | A | | 6/1989 | Weder | 29/525 |
| D301,991 | S | | 7/1989 | Van Sant | D11/149 |
| 4,900,390 | A | | 2/1990 | Colton et al. | 156/291 |
| 4,941,572 | A | | 7/1990 | Harris | 206/423 |
| 4,946,290 | A | | 8/1990 | Matyja | 383/10 |
| 4,980,209 | A | | 12/1990 | Hill | 428/34.1 |
| 4,989,396 | A | | 2/1991 | Weder et al. | 53/397 |
| D315,700 | S | | 3/1991 | Stephens | D11/151 |
| 5,005,760 | A | * | 4/1991 | van den Hoogen | 229/125.38 |
| 5,073,161 | A | | 12/1991 | Weder et al. | 493/154 |
| 5,074,675 | A | | 12/1991 | Osgood | 383/122 |
| 5,076,011 | A | | 12/1991 | Stehouwer | |
| 5,105,599 | A | | 4/1992 | Weder | 53/399 |
| 5,111,638 | A | | 5/1992 | Weder | 53/397 |
| 5,117,584 | A | | 6/1992 | Ottenwalder et al. | |
| 5,120,382 | A | | 6/1992 | Weder | 156/212 |
| 5,152,100 | A | | 10/1992 | Weder et al. | 47/72 |
| 5,181,364 | A | | 1/1993 | Weder | 53/397 |
| D335,105 | S | | 4/1993 | Ottenwalder et al. | D11/164 |
| 5,199,242 | A | | 4/1993 | Weder et al. | 53/397 |
| 5,205,108 | A | | 4/1993 | Weder et al. | 53/397 |
| 5,228,234 | A | | 7/1993 | de Klerk et al. | 47/41.01 |
| 5,235,782 | A | | 8/1993 | Landau | 47/72 |
| 5,239,775 | A | | 8/1993 | Landau | 47/72 |
| 5,249,407 | A | | 10/1993 | Stuck | 53/399 |
| 5,259,106 | A | | 11/1993 | Weder et al. | 29/469.5 |
| 5,307,606 | A | | 5/1994 | Weder | 29/469.5 |
| 5,315,785 | A | | 5/1994 | Avot et al. | 47/72 |
| 5,350,240 | A | | 9/1994 | Billman et al. | 383/104 |
| 5,353,575 | A | | 10/1994 | Stepanek | 53/461 |
| 5,361,482 | A | | 11/1994 | Weder et al. | 29/469 |
| 5,388,695 | A | | 2/1995 | Gilbert | 206/423 |
| 5,428,939 | A | | 7/1995 | Weder et al. | 53/397 |
| 5,443,670 | A | | 8/1995 | Landau | 156/191 |
| 5,493,809 | A | | 2/1996 | Weder et al. | 47/72 |
| D368,025 | S | | 3/1996 | Sekerak et al. | D9/305 |
| 5,496,251 | A | | 3/1996 | Cheng | 493/224 |
| 5,496,252 | A | | 3/1996 | Gilbert | 493/224 |
| 5,526,932 | A | | 6/1996 | Weder | 206/423 |
| 5,551,570 | A | | 9/1996 | Shaffer et al. | 206/575 |
| 5,572,849 | A | | 11/1996 | Weder et al. | 53/399 |
| 5,572,851 | A | | 11/1996 | Weder | 53/399 |
| 5,575,133 | A | | 11/1996 | Weder et al. | 53/397 |
| 5,617,703 | A | | 4/1997 | Weder | 53/413 |
| 5,624,320 | A | | 4/1997 | Martinez | 472/51 |
| 5,625,979 | A | | 5/1997 | Weder | |
| 5,647,168 | A | | 7/1997 | Gilbert | 47/72 |
| 5,647,193 | A | | 7/1997 | Weder et al. | 53/465 |
| 5,706,605 | A | | 1/1998 | Alcazar et al. | 47/65.7 |
| 5,715,944 | A | | 2/1998 | Windisch | 206/423 |
| 5,735,103 | A | | 4/1998 | Weder | 53/399 |

| | | | | |
|---|---|---|---|---|
| 5,758,472 | A | 6/1998 | Weder | |
| 5,813,194 | A | 9/1998 | Weder | 53/399 |
| D404,684 | S | 1/1999 | Shea | D11/164 |
| 5,924,241 | A | 7/1999 | Hodge | 47/72 |
| 5,941,020 | A | 8/1999 | Weder | 47/72 |
| 5,966,866 | A | 10/1999 | Ferguson | 47/41.01 |
| 5,974,730 | A | 11/1999 | Chien | 47/41.01 |
| D419,436 | S | 1/2000 | Celtorius et al. | D9/305 |
| 6,009,687 | A | 1/2000 | Weder | 53/399 |
| 6,047,524 | A | 4/2000 | Weder | 53/399 |
| D424,972 | S | 5/2000 | Ferguson | D11/143 |
| 6,098,336 | A | 8/2000 | Ferguson | 206/423 |
| 6,129,208 | A | 10/2000 | Ferguson | 206/423 |
| 6,129,209 | A | 10/2000 | Tchira | 206/423 |
| 6,141,906 | A | 11/2000 | Weder | 47/72 |
| 6,182,395 | B1 | 2/2001 | Weder et al. | 47/72 |
| 6,183,590 | B1 | 2/2001 | Weder | 47/72 |
| 6,286,255 | B1 | 9/2001 | Weder et al. | |
| 6,286,256 | B1 | 9/2001 | Weder | |
| 6,345,467 | B1 | 2/2002 | Weder | |
| 6,647,663 | B2 * | 11/2003 | Weder | 47/72 |

FOREIGN PATENT DOCUMENTS

| | | |
|---|---|---|
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| DK | 1204647 | 9/1970 |
| EP | 0050990 | 5/1982 |
| EP | 0791543 | 8/1997 |
| FR | 1084888 | * 10/1953 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2567068 | 7/1984 |
| FR | 2610604 | 8/1988 |
| FR | 2603159 | 3/1989 |
| FR | 2619698 | 3/1989 |
| GB | 5605 | 5/1885 |
| GB | 1204647 | 9/1970 |
| GB | 2056410 | 3/1981 |
| GB | 2074542 | 11/1981 |
| GB | 2128083 | 4/1984 |
| GB | 2203127 | 10/1988 |
| GB | 2212136 | 7/1989 |
| GB | 2252708 | 8/1992 |
| IT | 224507 | 4/1996 |
| JP | 542958 | 2/1993 |
| JP | 6127555 | 5/1994 |
| JP | 819334 | 1/1996 |
| NL | 8301709 | 12/1984 |
| NL | 1000658 | 1/1996 |
| WO | 9315979 | 8/1993 |
| WO | 9712819 | 4/1997 |

* cited by examiner

PLANT SLEEVE

CROSS REFERENCE TO RELATED APPLICATIONS

The present application is a continuation of U.S. Ser. No. 10/195,595, filed Jul. 12, 2002, now U.S. Pat. No. 6,647,663, issued Nov. 18, 2003, which is a continuation-in-part of U.S. Ser. No. 09/956,833, filed Sep. 20, 2001, now U.S. Pat. No. 6,438,898, issued on Aug. 27, 2002, which is a continuation-in-part of U.S. Ser. No. 09/327,721, filed Jun. 8, 1999, now U.S. Pat. No. 6,295,760, issued Oct. 2, 2001, which is a continuation-in-part of U.S. Ser. No. 09/022,958, filed Feb. 12, 1998, now U.S. Pat. No. 5,910,051, issued Jun. 8, 1999, entitled "SLEEVE HAVING A DETACHABLE PORTION FORMING A SKIRT AND METHODS," which is a continuation of U.S. Ser. No. 08/788,616, filed Jan. 27, 1997, entitled "SLEEVE HAVING A DETACHABLE PORTION FORMING A SKIRT AND METHODS," now U.S. Pat. No. 5,749,171, issued on May 12, 1998. The specification of each of the patents or patent applications listed herein is hereby incorporated herein by reference in its entirety.

FIELD OF THE INVENTION

This invention generally relates to sleeves and, more particularly, to sleeves used to contain floral groupings or media or used to wrap flower pots containing floral groupings and/or media containing floral groupings, and methods of using same.

DESCRIPTION OF THE PREFERRED EMBODIMENTS

The present invention contemplates a plant sleeve comprising in one embodiment a combination of a protective upper portion and a decorative lower portion having a base portion and skirt portion for packaging a potted plant, a plant, or a plant and growing medium. The protective upper portion can be detached from the lower decorative portion of the plant sleeve once the protective function of the upper portion has been completed, thereby exposing the decorative cover portion and allowing the skirt portion to extend angularly from the base portion. The protective upper and lower decorative cover portions may comprise a unitary construction or may comprise separate components which are attached together by various bonding materials prior to disposition of the pot therein.

More specifically, the present invention in a preferred embodiment contemplates a sleeve for covering a pot having an outer peripheral surface. The sleeve comprises (1) a lower portion having a lower end, an upper end, an outer peripheral surface, and a diagonally and horizontally oriented area of excess material (one or more expansion elements) for allowing extension or expansion of a portion of the base portion, and (2) an upper portion extending from the upper end of the lower portion and detachable therefrom, and wherein when the upper portion is detached from the upper end of the lower portion, or when a pot is placed in the sleeve, the area of excess material can expand causing portions of the lower portion to extend. In general, the lower portion is sized to substantially cover the outer peripheral surface of the pot. The upper portion may be detachable via a detaching element such as perforations, tear strips and zippers. The sleeve may also have an extended portion extending from the upper portion for serving as a handle or support device.

The expansion element is integral to the lower portion and optionally integral to the upper portion, for allowing expansion of a portion of the lower portion into a skirt extending angularly from the lower portion when the upper portion is detached from the upper end of the lower portion. The expansion element, in a preferred embodiment, may be one or more pleats, one or more folds each having a Z-shaped cross section, one or more accordion-type folds, or other similar types of expandable forms, wherein the folds, creases, or pleats extend about at least a portion of the circumference of the sleeve. In another embodiment the sleeve is constructed without a detachable upper portion wherein the sleeve has a lower portion having a base portion and skirt portion.

These embodiments and others of the present invention are now described in more detail below.

Figure 1:
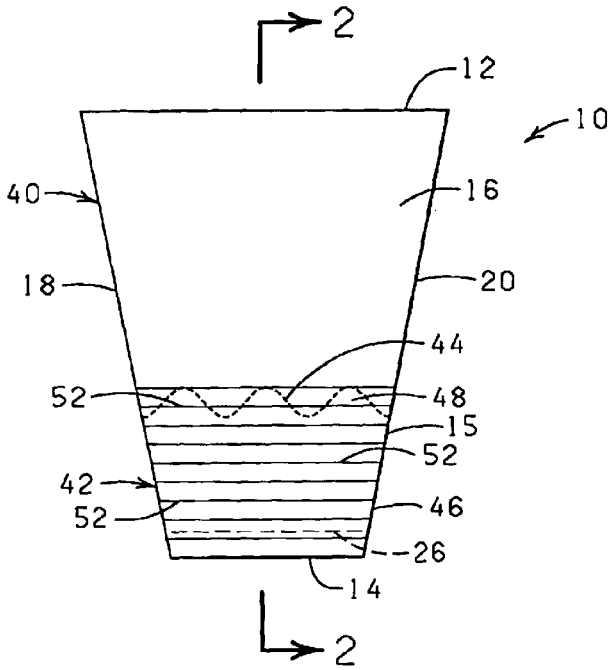
FIG. 1 is an elevational view of a sleeve having detaching elements and horizontal expansion elements constructed in accordance with the present invention.

Shown in FIG. 1 and designated therein by the general reference numeral 10 is a flexible sleeve of unitary construction. The sleeve 10 is initially constructed in a flattened condition and is openable into the form of a tube or tubular sleeve, hereinafter referred to herein as "sleeve". The sleeve 10 may be tapered outwardly from the lower end toward a larger diameter at its upper end. In its flattened condition the sleeve 10 typically has an overall trapezoidal or modified trapezoidal shape, and when opened is substantially frustoconical to coniform.

Figure 2:
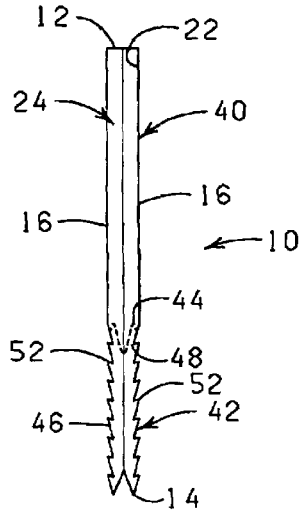
FIG. 2 is a cross-sectional view of the sleeve of FIG. 1, taken along line 2—2 thereof.
Figure 6:
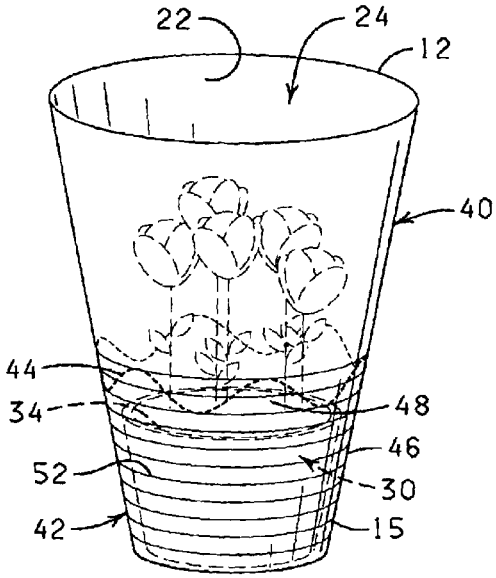
FIG. 6 is a perspective view of the sleeve of FIG. 1 having a pot disposed therein.

The sleeve 10 has an upper end 12, a lower end 14, a sidewall 15 having an outer peripheral surface 16 and in its flattened state has a first side 18 and a second side 20. The sleeve 10 has an opening at the upper end 12 and may be open at the lower end 14, or closed with a bottom at the lower end 14. The sleeve 10 also has an inner peripheral surface 22 which, when the sleeve 10 is opened, defines and encompasses an inner retaining space 24 as shown in FIGS. 2 and 6. When the lower end 14 of the sleeve 10 has a closed bottom, a portion of the lower end 14 may be constructed of excess material to form one or more gussets (such as a gusset 26 shown in FIG. 1) for permitting a bottom of an object, such as a potted plant, to be more conveniently disposed into the inner retaining space 24 and to form a flatter bottom in the lower end 14 of the sleeve 10.

The sleeve 10 is generally frusto-conically shaped, but the sleeve 10 may be, by way of example but not by way of limitation, cylindrical, frusto-conical, a combination of both frusto-conical and cylindrical, or any other shape, as long as the sleeve 10 functions as described herein as noted above. Further, the sleeve 10 may comprise any shape, whether geometric, non-geometric, asymmetrical and/or fanciful as long as it functions in accordance with the present invention. The sleeve 10 may also be equipped with drains or ventilation holes (not shown), or can be made from permeable or impermeable materials.

The material from which the sleeve 10 is constructed has a thickness in a range from about 0.1 mil to about 30 mils. Often, the thickness of the sleeve 10 is in a range from about 0.5 mil to about 10 mils. Preferably, the sleeve 10 has a thickness in a range from about 1.0 mil to about 5 mils. More preferably, the sleeve 10 is constructed from a material which is flexible, semi-rigid, rigid, or any combination thereof. The sleeve 10 may be constructed of a single layer of material or a plurality of layers of the same or different types of materials. Any thickness of the material may be utilized as long as the material functions in accordance with the present invention as described herein. The layers of material comprising the sleeve 10 may be connected together or laminated or may be separate layers. Such materials used to construct the sleeve 10 are described in U.S. Pat. No. 5,111,637 entitled "Method For Wrapping A Floral Grouping" issued to Weder et al., on May 12, 1992, which is hereby expressly incorporated herein by reference. Any thickness of material may be utilized in accordance with the present invention as long as the sleeve 10 may be formed as described herein, and as long as the formed sleeve 10 may contain at least a portion of a pot or potted plant or a floral grouping, or growing medium as described herein. Additionally, an insulating material such as bubble film, preferably one of two or more layers, can be utilized in order to provide additional protection for the item, such as the floral grouping, contained therein.

In one embodiment, the sleeve 10 may be constructed from two polypropylene films. The polypropylene films used in the construction of the sleeve 10 may be connected together or laminated or may be separate layers. In an alternative embodiment, the sleeve 10 may be constructed from only one of the polypropylene films.

The sleeve 10 is constructed from any suitable material that is capable of being formed into a sleeve and disposed about a pot 30 (FIG. 6) and a floral grouping or plant 32 disposed therein. Preferably, the material comprises paper (untreated or treated in any manner), metal foil, polymeric film, non-polymeric film, fabric (woven or nonwoven or synthetic or natural), cardboard, fiber, cloth, burlap, or laminations or combinations thereof.

The term "polymeric film" means a man-made polymer such as a polypropylene or a naturally occurring polymer such as cellophane. A polymeric film is relatively strong and not as subject to tearing (substantially non-tearable), as might be the case with paper or foil.

The material comprising the sleeve 10 may vary in color and may consist of designs or decorative patterns which are printed, etched, and/or embossed thereon using inks or other printing materials. An example of an ink which may be applied to the surface of the material is described in U.S. Pat. No. 5,147,706 entitled "Water Based Ink On Foil And/Or Synthetic Organic Polymer" issued to Kingman on Sep. 15, 1992 and which is hereby incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. Each of the above-named characteristics may occur alone or in combination and may be applied to the upper and/or lower surface of the material comprising the sleeve 10. Moreover, portions of the material used in constructing the sleeve 10 may vary in the combination of such characteristics. The material utilized for the sleeve 10 itself may be opaque, translucent, transparent, or partially clear or tinted transparent.

It will generally be desired to use the sleeve 10 as a covering for the pot 30 (FIGS. 6 and 7) having the floral grouping or plant 32 disposed therein. A lower end of the pot 30 is closed but may have holes for permitting water drainage. The term "pot" as used herein refers to any type of container used for holding the floral grouping or plant 32. Examples of pots, used in accordance with the present invention include, but not by way of limitation, clay pots, wooden pots, plastic pots, foam pots, pots made from natural and/or synthetic fibers, or any combination thereof. The pot 30 is adapted to receive the floral grouping or plant 32 in a retaining space thereof. The floral grouping or plant 32 may be disposed within the pot 30 along with a suitable growing medium described in further detail below, or other retaining medium, such as a floral foam. It will also be understood that the floral grouping or plant 32, and any appropriate growing medium or other retaining medium such as floral foam, may be disposed in the sleeve 10 without the pot 30 wherein the sleeve 10 is used as a pot itself. Or the plant 32 may be disposed in the sleeve 10 alone.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping or plant 32 generally comprises a bloom or foliage portion and a stem portion. Further, the floral grouping or plant 32 may comprise a growing potted plant having a root portion (not shown) as well. However, it will be appreciated that the floral grouping or plant 32 may consist of only a single bloom or only foliage, or a botanical item (not shown), or a propagule (not shown). The term "floral grouping" may be used interchangeably herein with both the terms "floral arrangement" and "plant". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, foam, sand, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

In accordance with the present invention, a bonding material (not shown) may be disposed on a portion of the sleeve 10 to assist in holding the sleeve 10 to the pot 30 having the floral grouping 32 therein when such a pot 30 is disposed within the sleeve 10 or to assist in closing the upper end 12 of the sleeve 10 or adhering the sleeve 10 to the pot 30 after the pot 30 has been disposed therein. Examples of sleeves with bonding material thereon are disclosed in U.S. Pat. Nos. 5,625,979 and 5,572,851, the specification of each of which is hereby specifically incorporated by reference herein in its entirety.

As shown in FIGS. 1, 2 and 6, the sleeve 10 is demarcated into an upper portion 40 and a lower portion 42. The lower portion 42 of the sleeve 10 is generally sized to contain the pot 30. The upper portion 40 of the sleeve 10 is preferably sized to substantially surround and encompass the floral grouping or plant 32 alone or in the pot 30 disposed within the lower portion 42 of the sleeve 10 (FIG. 6). The sleeve 10 is demarcated into the upper portion 40 and the lower portion 42 by a detaching element 44 preferably having a non-linear pattern or shape for enabling the detachment of the upper portion 40 of the sleeve 10 from the lower portion 42 of the sleeve 10. In the preferred version, the detaching element 44 is a plurality of generally non-linear or laterally-oriented or alternatingly diagonally-oriented perforations which extend circumferentially across the outer peripheral surface 16 of the sleeve 10 from the first side 18 to the second side 20. The term "detaching element," as used generally herein, means any element, or combination of elements, or features, such as, but not by way of limitation, perforations, tear strips, zippers, and any other devices or elements of this nature known in the art, or any combination thereof, which enable the tearing away or detachment of one object from another. The perforations may have a linear or arcuate pattern as well. Therefore, while perforations are shown and described in detail herein, it will be understood that tear strips, zippers, or any other "detaching elements" known in the art, or any combination thereof, could be substituted therefore and/or used therewith. Other examples of perforation patterns which may be used herein are shown in FIGS. 26–31 in U.S. Pat. No. 5,493,809, the specification of which is expressly incorporated herein by reference in its entirety.

Figure 7:
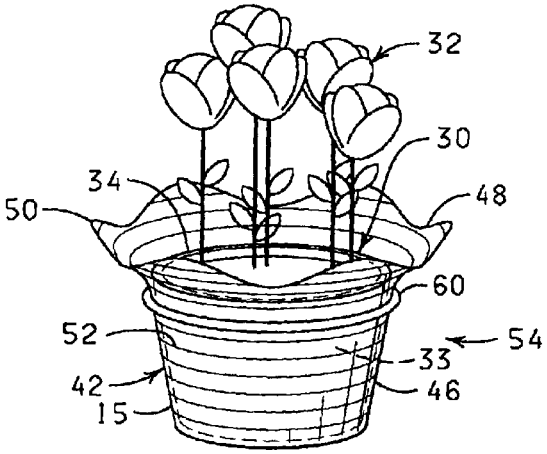
FIG. 7 is a perspective view of the sleeve and pot of FIG. 6 after an upper sleeve portion has been removed.

In a preferred embodiment, the lower portion 42 of the sleeve 10 further comprises a base portion 46, and a skirt portion 48. The base portion 46 comprises that part of the lower portion 42 which, when the pot 30 is placed into the lower portion 42 (FIG. 6), has an inner peripheral surface which is substantially adjacent to and surrounds an outer peripheral surface 33 of the pot 30. The skirt portion 48 comprises that part of the lower portion 42 which extends beyond an upper rim 34 of the pot 30 and around at least a portion of the floral grouping or plant 32 contained within the pot 30 and which is left to freely extend inwardly or outwardly, or upwardly from the base portion 46 when the upper portion 40 of the sleeve 10 is detached from the lower portion 42 of the sleeve 10 via the detaching element 44. The degree of the angle may also be zero wherein the skirt portion 48 extends straight up from the base portion 46. When the upper portion 40 is detached, the skirt portion 48 or lower portion 42 is left with an upper peripheral edge 50 which preferably has a non-linear pattern or shape as indicated in FIG. 7. The non-linear pattern or shape of the upper peripheral edge 50 may be curved, zig-zagged, toothed, angular, crenate, crenulate, crenelate, sine-wave, or any other non-linear pattern known to a person of ordinary skill in the art.

Figure 5:
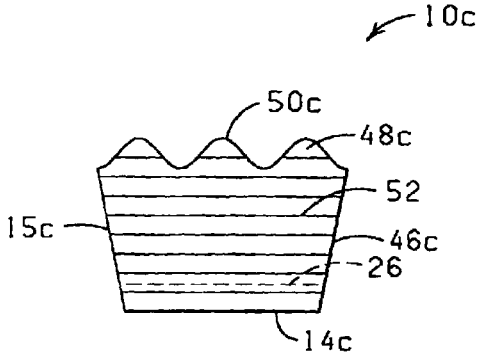
FIG. 5 is an elevational view of a version of a sleeve constructed without a detachable upper portion.

Shown in FIG. 5, the sleeve 10*c* may be constructed without a detachable upper portion and may be constructed with an upper end 12*c* having an upper peripheral edge 50*c* having a non-linear pattern, and constituting an edge of a skirt portion 48*c*, extending from a base portion 46*c*. The sleeve 10*c* has a lower end 14*c*, and a sidewall 15*c*, and optionally a gusset 26.

It will be understood that equipment and devices for forming floral sleeves are commercially available, and are well known to a person of ordinary skill in the art. Further discussion of their construction and operation is therefore not deemed to be necessary.

As noted above, the sleeve 10 may have an open or closed lower end 14. When the lower end 14 is closed, the lower end 14 may have one or more gussets 26 (FIG. 1) formed therein as noted previously for allowing expansion of the lower end 14 when an object with a broad lower end such as the pot 30 is disposed therein. In another version of the present invention (not shown), a strip of bonding material may be disposed on a portion of the upper portion 40 of the sleeve 10 generally in the vicinity of the upper end 12 of the sleeve 10 for allowing the upper end 12 to be sealed for enclosing the upper portion 40 of the sleeve 10 about the floral grouping or plant 32 disposed therein. The gusset 26 is intended to be representative of gussets in general. Gussets and their construction are well known in the art of packaging.

The sleeve 10 further includes at least one horizontal expansion element 52. The horizontal expansion element 52 is integral to at least one of the base portion 46 and the skirt portion 48 and may extend into the upper portion 40 as shown in FIG. 1. The horizontal expansion element 52 functions to allow expansion of portions of the base portion 46 and/or skirt portion 48 of the sleeve 10. For example, when the upper portion 40 is detached from the lower portion 42 to form an upper peripheral edge 50. The horizontal expansion elements 52 in the base portion 46 may also serve to enable the outward expansion of the base portion 46 to conform to the pot 30 or other objects or materials placed within the base portion 46.

Each horizontal expansion element 52 defined herein comprises one or more areas of excess material shaped in the form of a pleat, crease, or fold which extends at least partially about the circumference of the sleeve 10. As used herein, the term "excess material" means an amount of material which has a greater surface area than would actually be necessary to form that portion of the sleeve 10 were that portion of the sleeve 10 actually flattened. The horizontal expansion element 52 can expand causing portions of the skirt portion 48 to extend from the base portion 46 about a portion of the floral grouping or plant 32 in the pot 30 as shown in FIG. 7. The one or more horizontal expansion elements 52 may extend from the lower end 14 upward to the skirt portion 48 and beyond, or may only comprise a portion of the base portion 46 (see for example U.S. Pat. No. 5,910,051, the specification of which is hereby incorporated herein by reference).

Shown in FIG. 2 is a cross-sectional view of the sleeve 10 which shows one embodiment of horizontal expansion elements 52 which have a z-shape in cross-section. When the upper portion 40 is removed, the horizontal expansion elements 52 can expand.

Figure 3:
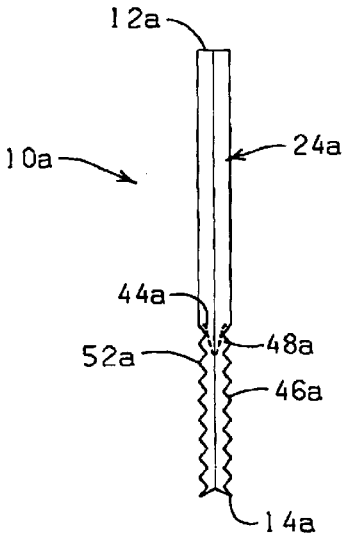
FIG. 3 is a cross-sectional view of another embodiment of a sleeve constructed in accordance with the present invention.

Attention is now drawn to FIG. 3 and to the cross-sectional view of a sleeve 10*a*. Sleeve 10*a* has an upper end 12*a*, a lower end 14*a*, an inner space 24*a*, and horizontal expansion elements designated by the general reference numeral 52*a*. The horizontal expansion elements 52*a* have a pleated shape in cross-section and can expand as described above causing portions of a base portion 46*a* and/or skirt portion 48*a* to expand.

Figure 4:
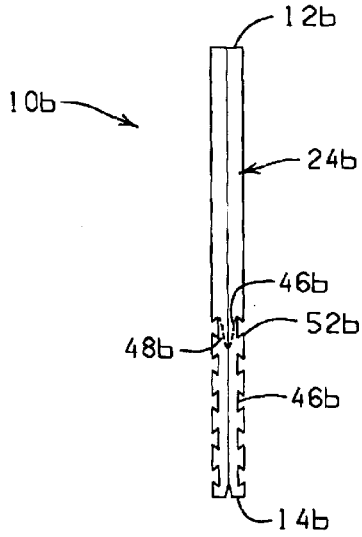
FIG. 4 is a cross-sectional view of a yet another embodiment of a sleeve constructed in accordance with the present invention.

Attention is now drawn to FIG. 4 and to expansion elements shown therein which are designated by the general reference numeral 52*b*. Sleeve 10*b* has an upper end 12*b*, a lower end 14*b* and an inner retaining space 24*b*. Sleeve 10*b* is similar to the sleeve 10 described above except that the sleeve 10*b* of FIG. 4 has a plurality of fluted or groove-shaped horizontal expansion elements 52*b*. As before, the horizontal expansion elements 52*b* of sleeve 10*b* can expand causing portions of a base portion 46*b* and/or a skirt portion 48*b* to expand.

It will be appreciated by one of ordinary skill in the art that the shapes of the horizontal expansion elements 52–52*b* described above are but several of the shapes which can be contemplated for the present invention. Other shapes which may be contemplated are gussets, fans, and "accordion-folds" to name but a few.

Figure 8:
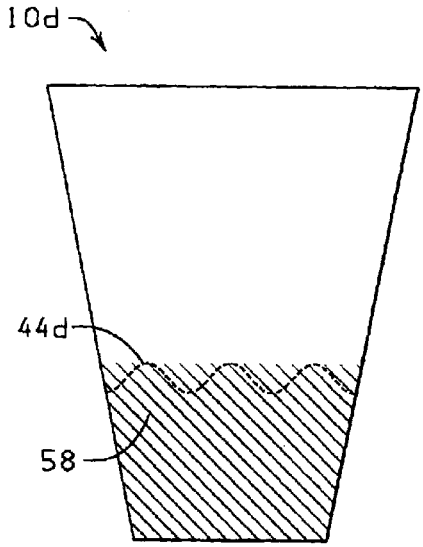
FIG. 8 is an elevational view of a sleeve having diagonally oriented expansion elements.
Figure 9:
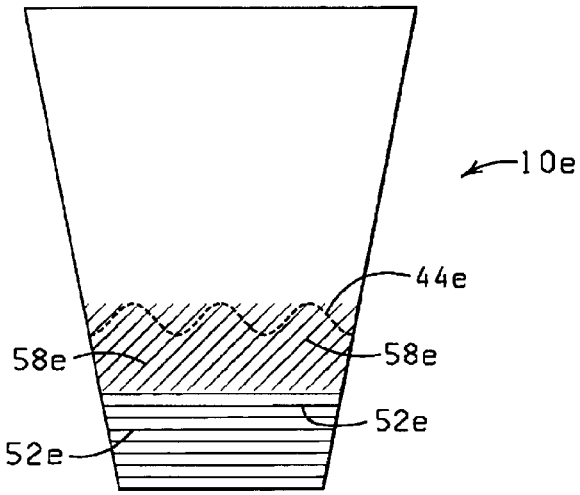
FIG. 9 is an elevational view of a sleeve having both diagonally and horizontally oriented expansion elements.
Figure 10:
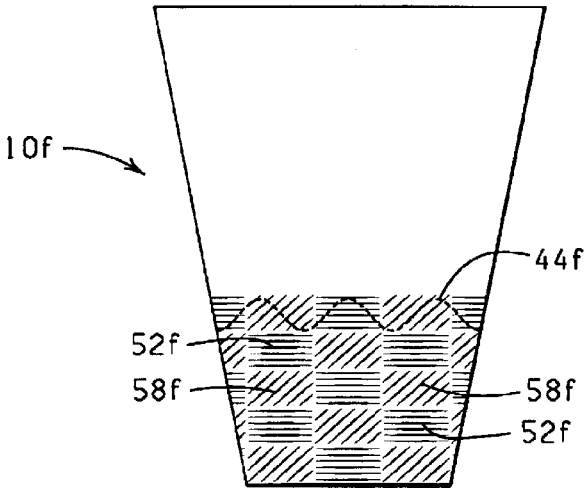
FIG. 10 is an elevational view of another sleeve having diagonally and horizontally oriented expansion elements.

Further, where used herein, the term "horizontal" expansion element may also include expansion elements which are diagonally oriented in the sleeve. FIG. 8, for example, shows a sleeve 10*d* having a detaching element 44*d*, and having expansion elements 58 which are diagonally oriented. FIGS. 9 and 10 show two embodiments of flattened sleeves referred to herein as sleeves 10*e* and 10*f*, respectively, which comprise both horizontal and diagonal expansion elements. Sleeve 10*e* has a detaching element 44*e*, horizontal expansion elements 52*e* and diagonal expansion elements 58*e*. Sleeve 10*f* has a detaching element 44*f*, horizontal expansion elements 52*f* and diagonal expansion elements 58*f*. The patterns of horizontal and diagonal expansion elements shown in sleeves 10*e* and 10*f* constitute only two types of embodiments having both horizontal and diagonal expansion elements. In another version the expansion elements could be dispersed more or less randomly over the sleeve. Alternately, any of the sleeves described elsewhere herein could be formed with both horizontal and diagonal expansion elements.

Each of the sleeves 10–10*f* described herein may further include a support extension (not shown herein but shown for example in U.S. Pat. No. 5,625,979, which is expressly incorporated herein by reference) which extends away from a portion of an upper end of such sleeve. The support extension may have one or more apertures disposed therein for allowing the sleeve to be supported on a support assembly which may comprise, for example, a pair of wickets for shipment, storage, assembly of the sleeves, placement of a pot within the sleeve, or other functions known in the art. The support extension may have a plurality of perforations or other detaching means for allowing the support extension to be removed from the sleeve after the sleeve has been provided for use as described elsewhere herein. In another version of the invention, and applicable to any of the sleeves 10–10*f* described above, or elsewhere herein, a sleeve has a handle for carrying the potted plant package by the sleeve. The sleeve 10–10*f* so modified may further comprises a detaching element comprising perforations for removing the handle at a later time.

As noted above, the upper portion 40 and lower portion 42 of the present invention may comprise a unitary construction, or may comprise separately formed components which are connected together by various bonding materials prior to application of the sleeve 10–10*f* about the pot 30.

Further, any of the sleeves 10–10*f* described herein may be secured about the pot 30 or plant 32 disposed therein by a bonding element such as bonding element 60 shown in FIG. 7. The bonding element 60 may be a string, wire, plastic strip, elastic band, ribbon, rigid collar, heat shrinkable band, or any other banding element known in the art.

Changes may be made in the construction and the operation of the various components, elements and assemblies described herein or in the steps or the sequence of steps of the methods described herein without departing from the spirit and scope of the invention as defined in the following claims.

What is claimed is:

1. A tubular sleeve for containing a plant or for covering a pot having an outer peripheral surface, the tubular sleeve comprising:

a lower portion initially having a flattened condition, a sidewall, a lower end, and an area of excess material comprising a plurality of preformed creases or folds positioned in horizontal and diagonal orientation in the sidewall; and an upper portion extending from the lower portion and detachable therefrom via a detaching element disposed within the tubular sleeve.

2. The tubular sleeve of claim 1 wherein the lower portion comprises a base portion sized to substantially cover the outer peripheral surface of the pot.

3. The tubular sleeve of claim 1 wherein the lower portion further comprises a skirt portion having a non-linear upper peripheral edge.

4. The tubular sleeve of claim 1 further defined as constructed from a material selected from the group consisting of treated or untreated paper, metal foil, polymeric film, non-polymeric film, cardboard, fiber, cloth, burlap, and laminations or combinations thereof.

5. The tubular sleeve of claim 1 wherein the detaching element is selected from the group consisting of perforations, tear strips and zippers.

6. The tubular sleeve of claim 1 wherein the preformed creases or folds further comprise pleats, folds with a z-shaped cross section, or accordion-type folds.

7. The tubular sleeve of claim 1 wherein the lower end is open.

8. The tubular sleeve of claim 1 wherein the lower end is closed.

9. The tubular sleeve of claim 8 wherein the closed lower end has a gusset therein.

10. The tubular sleeve of claim 1 having a bonding material disposed thereon.

11. The tubular sleeve of claim 1 wherein the upper portion is adapted to support the tubular sleeve from a support assembly.

12. A tubular sleeve for containing a plant or for covering a pot having an outer peripheral surface, the tubular sleeve comprising:

a base portion having a lower end and a sidewall, the sidewall comprising an area of excess material comprising a plurality of preformed creases or folds positioned in horizontal and diagonal orientation;

a skirt portion extending from the base portion; and an upper portion extending from the skirt portion and detachable therefrom via a detaching element disposed within the tubular sleeve.

13. The tubular sleeve of claim 12 wherein the base portion is further defined as being sized to substantially cover the outer peripheral surface of the pot.

14. The tubular sleeve of claim 12 further defined as constructed from a material selected from the group consisting of treated or untreated paper, metal foil, polymeric film, non-polymeric film, cardboard, fiber, cloth, burlap, and laminations or combinations thereof.

15. The tubular sleeve of claim 12 wherein the detaching element is selected from the group consisting of perforations, tear strips and zippers.

16. The tubular sleeve of claim 12 wherein the preformed creases or folds further comprise pleats, folds with a z-shaped cross section, or accordion-type folds.

17. The tubular sleeve of claim 12 wherein the lower end is open.

18. The tubular sleeve of claim 12 wherein the lower end is closed.

19. The tubular sleeve of claim 18 wherein the closed lower end has a gusset therein.

20. The tubular sleeve of claim 12 having a bonding material disposed thereon.

21. The tubular sleeve of claim 12 wherein the detaching element has a non-linear pattern.

22. The tubular sleeve of claim 12 wherein the upper portion is adapted to support the tubular sleeve from a support assembly.

* * * * *

UNITED STATES PATENT AND TRADEMARK OFFICE

CERTIFICATE OF CORRECTION

PATENT NO. : 6,962,021 B2
APPLICATION NO. : 10/666576
DATED : November 8, 2005
INVENTOR(S) : Donald E. Weder It is certified that error appears in the above-identified patent and that said Letters Patent is hereby corrected as shown below:

Item (73) Assignee: Change "Wanda H. Weder" to --Wanda M. Weder--.

Item (56) Other Publications: add the following references:

--"Costa Keeps the Christmas Spirit", Supermarket Floral, September 15, 1992.--
--"Super Seller", Supermarket Floral, September 15, 1992.--
--"Halloween", Link Magazine, September 1992.--
--"Now More Than Ever", Supermarket Floral, September 15, 1992.--
--Le Plant Sac Advertisement, published prior to September 26, 1987.--
--"A World of Cut Flower and Pot Plant Packaging" Brochure, Klerk's Plastic Products Manufacturing, Inc., published prior to March 31, 1994, 6 pages.--
--Chantler & Chantler brochure showing Zipper Sleeve™ and Florasheet®, published prior to March 31, 1994, 2 pages.--
--"Stand Alone Plastic Bagmaking" brochure, AMI, Atlanta, GA, February 15, 1996, 2 pages.--
--"Foil Jackets" brochure, Custom Medallion, Inc., December, 1996, 2 pages.--
--"Derwent Abstract" of FR 2610604A. It is noted that the abstract is an incorrect English translation of the contents of the French patent. The French patent does not enable or disclose adhesively attaching the covering to the container. 1988.--
--"Silver Linings" Brochure, Affinity Diversified Industries, Inc., 1986. The Silver Linings brochure shows a floral sleeve with a closed bottom. The brochure shows , in one embodiment, a vase with flowers inside a "cut flower" sleeve with the sleeve tied with a ribbon about the neck of the vase.--
--"Special Occasion Printed Highlophane Bags" Brochure, Highland Supply Corporation, 1990, 2 pages.--
--"Creative Packaging" Brochure, John Henry Company, Sept. 1992.--

UNITED STATES PATENT AND TRADEMARK OFFICE

CERTIFICATE OF CORRECTION

PATENT NO. : 6,962,021 B2
APPLICATION NO. : 10/666576
DATED : November 8, 2005
INVENTOR(S) : Donald E. Weder It is certified that error appears in the above-identified patent and that said Letters Patent is hereby corrected as shown below:

--"Make Highlander Your Headquarters" Brochure, Highland Supply Corporation, 1991.--
--WEDER ET AL., "Sleeve with a Triangular Lower End", U.S. Patent Application Publicaton, Pub. No. US 2002/0112401 A1, Pub. Date: 08/22/2002.--

Signed and Sealed this

Twenty-sixth Day of September, 2006

JON W. DUDAS
*Director of the United States Patent and Trademark Office*